US007982632B2

(12) United States Patent
Miller, Jr.

(10) Patent No.: US 7,982,632 B2
(45) Date of Patent: Jul. 19, 2011

(54) SENSOR SYSTEM AND METHOD OF COMMUNICATING DATA BETWEEN A DOWNHOLE DEVICE ON A REMOTE LOCATION

(75) Inventor: Joseph A. Miller, Jr., League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 1112 days.

(21) Appl. No.: 11/743,373

(22) Filed: May 2, 2007

(65) Prior Publication Data

US 2007/0284098 A1 Dec. 13, 2007

Related U.S. Application Data

(62) Division of application No. 10/863,449, filed on Jun. 8, 2004, now Pat. No. 7,436,320.

(60) Provisional application No. 60/479,107, filed on Jun. 16, 2003.

(51) Int. Cl.
*G01V 3/00* (2006.01)

(52) U.S. Cl. ..... 340/854.6; 375/287; 375/317; 166/250.01; 455/296

(58) Field of Classification Search ..... 340/854.6; 375/254, 287, 317, 319; 166/250.01; 455/296
See application file for complete search history.

(56) References Cited

U.S. PATENT DOCUMENTS 3,959,767 A 5/1976 Smither et al.
4,387,465 A * 6/1983 Becker ..... 375/130
4,575,683 A * 3/1986 Roberts et al. ..... 329/311
4,689,620 A 8/1987 Wondrak
5,311,554 A * 5/1994 Morera et al. ..... 375/316
5,375,098 A 12/1994 Malone et al.
5,467,083 A * 11/1995 McDonald et al. ..... 340/854.6
5,602,868 A 2/1997 Wilson
5,995,020 A 11/1999 Owen et al.
6,094,461 A * 7/2000 Heron ..... 375/317
6,173,018 B1 * 1/2001 Kuroki ..... 375/317
6,633,752 B1 * 10/2003 Hashigaya ..... 455/296
6,817,412 B2 * 11/2004 Haase ..... 166/250.01
7,042,961 B2 * 5/2006 Milton et al. ..... 375/317
2003/0151977 A1 8/2003 Shah et al.

OTHER PUBLICATIONS

Reservoir Monitoring Instrumentation; Guardian PM1625 TM; Paper QTX-03-4885; Quantx Wellbore Instrumentation; Quantx Houston; 2003; Revision 1; 2 pages.
Guardian Specifications Preliminary; Guardian Pressure and Temperature Tool Specifications Preliminary; Baker Oil Tools; Baker Hughes Inc.; May 2, 2008; pp. 1-35.

* cited by examiner

*Primary Examiner* — Albert K Wong
(74) *Attorney, Agent, or Firm* — Cantor Colburn LLP

(57) ABSTRACT

Disclosed herein is a sensor system having a sensor and at least one communication line operable with the sensor. The transmission medium is configured to convey data transmitted by the sensor to a remote location. The sensor transmits data on the communication line a plurality of times by at least two methods of transmission or modulation. Further disclosed herein is a method based on the foregoing. Further disclosed is a method of communicating by modifying a voltage amplitude of a signal and receiving the communication signal by employing a variable threshold detection circuit in the downhole device. Further disclosed is a system for communicating data between a downhole device and a remote location including a remote device for generating a communication signal, the remote device configured to modify a voltage amplitude of said communication signal.

20 Claims, 4 Drawing Sheets

SENSOR SYSTEM AND METHOD OF COMMUNICATING DATA BETWEEN A DOWNHOLE DEVICE ON A REMOTE LOCATION

CROSS-REFERENCE TO RELATED APPLICATIONS

This application is a division of U.S. application Ser. No. 10/863,449, filed Jun. 8, 2004, and it further claims the benefit of U.S. Provisional Application Ser. No. 60/479,107 filed Jun. 16, 2003, the entire contents of which is incorporated herein by reference.

BACKGROUND

In the hydrocarbon exploration and recovery industry, knowledge about conditions downhole are very valuable. Significant research and development has been engaged in over a larger number of years in the quest for further more reliable information. Some of the results of such research and development include the deployment of sensors to the downhole environment. These sensors include, among others, pressure and temperature sensors. Common in the art is to enable the communication of data gained by the sensors to the surface. Such communication has been made over a dedicated communication conductor or over the power conductor principally used to power a downhole current driven machine. Noise on the line, either directly from the machinery, as in the case of communication on the power line, or indirectly (coupling), as in the case of communication on a dedicated line can adversely affect the successful transmission of data. The coupled noise to the dedicated line would typically be from the power line. Such noise can affect the data transmission to a degree ranging from minimal degradation to complete obscurity of the transmission. Since such data is indeed valuable and its loss detrimental, current methods are inadequate.

SUMMARY

Disclosed herein is a sensor system having a sensor and at least one communication line operable with the sensor. The transmission medium is configured to convey data transmitted by the sensor to a remote location. The sensor transmits data on the communication line a plurality of times by at least two methods of transmission or modulation.

Further disclosed herein is a method of communicating data between a downhole device and a remote location comprising sending data a plurality of times using different modulation methods.

Further disclosed is a method of communicating data between a downhole device and a remote location by generating a communication signal at the remote location by modifying a voltage amplitude of the signal and receiving the communication signal by employing a variable threshold detection circuit in the downhole device, wherein the variable threshold detection facilitates dynamic determination of a threshold voltage under varying conditions.

Further disclosed is a system for communicating data between a downhole device and a remote location including a remote device for generating a communication signal, the remote device configured to modify a voltage amplitude of said communication signal. A transmission medium in operable communication with the surface device as well as a downhole device. The downhole device is configured to receive the communication signal generated at the remote device. The downhole device includes a variable threshold detection circuit to recover the communication signal, wherein the variable threshold detection facilitates dynamic determination of a threshold voltage under varying conditions.

BRIEF DESCRIPTION OF THE DRAWINGS

Referring now to the drawings wherein like elements are numbered alike in the several Figures.

DETAILED DESCRIPTION

Figure 1:
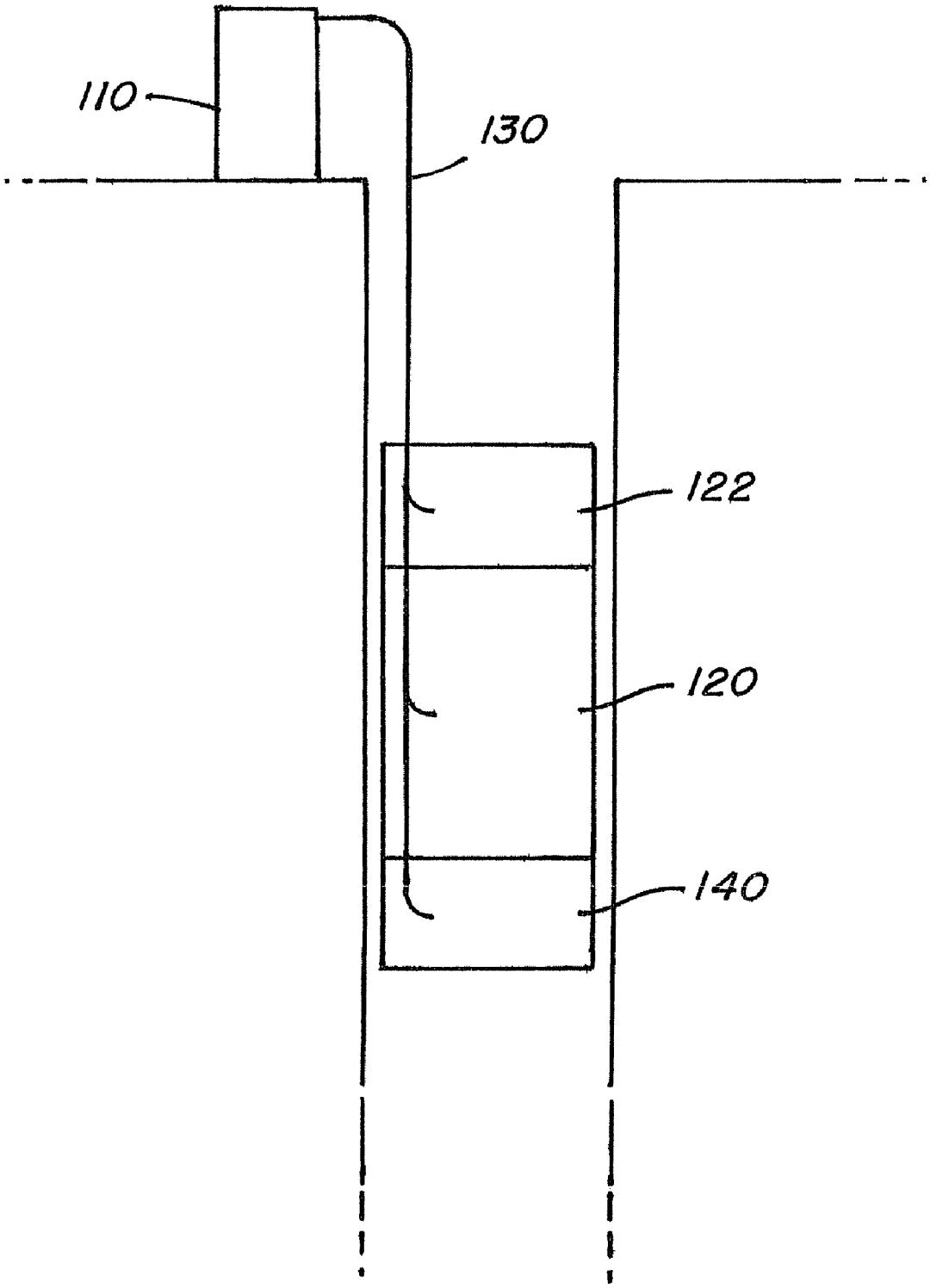
FIG. 1 is a schematic representation of a sensor connected to a remote location via a transmission media, which happens to be illustrated in a wellbore.

Referring to FIG. 1, hydrocarbon exploration and recovery equipment is schematically illustrated to include a remote location 110, (which may be a surface location), one or more downhole tool(s) 120, one or more sensor(s) 122 (or other device configured to transmit information or otherwise communicate) and a transmission media 130 between them. For example, the transmission media 130 (single line intended to represent one or more lines) may include, but is not limited to, interconnection line or wire, fiber optic cable, and the like, as well as combinations thereof including at least one of the foregoing. It should be noted that although the terms "downhole tool" and "sensor" are used herein, the term "device" is intended to encompass both of these and others as noted parenthetically above. Sensor 122 may be configured to sense any downhole parameter desired including, but not limited to, pressure, temperature, vibration, motor temperature, water cut, flow rate, capacitance, density, seismic properties or combinations including at least one of the foregoing. Transmission of the sensed data to a remote location, which may be a surface location, is along transmission media 130. One example of a sensor of a type contemplated herein is a modified Guardian™PM1625 pressure/temperature sensor. In an implementation of an exemplary embodiment, the Guardian™PM1625 sensor is modified by to include a threshold detection circuit 200 by: (1) scaling down the tool terminal voltage to fit in the input signal range of a voltage comparator, permitting the (command) voltage from the surface to be recovered; (2) adding an analog to digital converter to measure this voltage; (3) adding software functionality to a controller to facilitate deciphering this signal and to produce the modulation of the data and status sent to the remote location; (4) adding a digital to analog converter to drive the voltage comparator with a selected threshold voltage.

Figure 3:
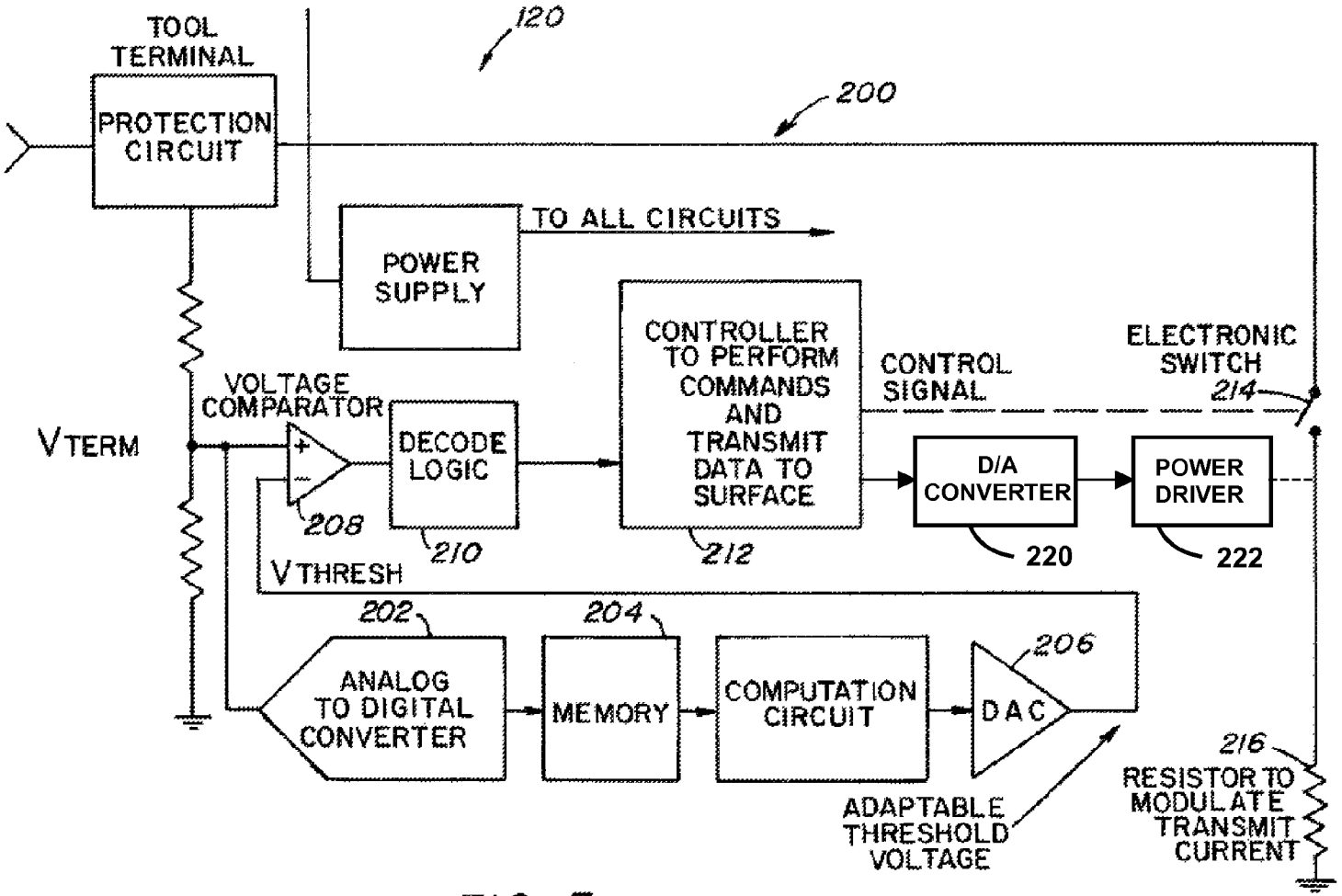
FIG. 3 depicts a simplified block diagram of an exemplary embodiment including a variable addressing threshold circuit.

It will be appreciated that a computation circuit for performing some or all of the functionality required may be implemented as dedicated hardware (as shown in FIG. 3), as software operating in the controller, such as a microcontroller, or device dependent code if the controller is configured as a programmable device e.g., a PAL, PLA, PLS, FPGA, and the like.

It should further be noted that while a comparator is described as added (and depicted in FIG. 3) the Guardian™PM1625 includes a spare comparator that is not presently used and may readily be employed for these purposes. Additional details of the characteristics and operation of an implementation of an exemplary embodiment of the threshold circuit 200 will be described at a later point herein.

Returning to FIG. 1, the transmission media 130 may be a dedicated communication line for one or more devices involved with one or more messages, or may be a line having another duty other than communication. An electrical submersible pump 140 is illustrated as it is relevant in that its existence and power supply represent one of the problems of data transmission to be overcome by the teaching herein. As a result of the operation of the pump 140 (and possibly an associated motor controller), electrical noise may be impressed on the transmission media 130 e.g., wire or transmission line that connects the sensor 122 to the remote or surface location 110. If the noise is of sufficient magnitude and/or in substantially the same frequency range as the data that the sensor 122 transmits, discrimination between data and noise becomes difficult, and data errors may occur.

In accordance with a first embodiment of this disclosure, sensor 122 is configured to redundantly transmit data. In one embodiment, data is transmitted three times. In addition, the transmission is not merely repeated but is also specially modulated so that at least two of the transmissions are distinct. In another embodiment, each transmission is distinct. By transmitting data a number of times, and by changing the transmission method each time, "noise" on the media 130 is less likely to obscure all of the data being transmitted. Transmission methods may include, but not be limited to frequency modulation (FM), frequency shift keying (FSK) or phase shift keying (PSK) or by spread spectrum technology, among others.

Frequency shift keying (FSK) is a method of transmitting digital signals especially over significant distances. The two binary states of a digital code, logic 0 (low) and logic 1 (high), are each represented by an analog waveform. Logic 0 is represented by a wave at a specific frequency, and logic 1 is represented by a wave at a different frequency. For example, a modem converts the binary data from a computer to FSK for transmission over telephone lines, cables, optical fiber, or wireless media. The modem also converts incoming FSK signals to digital low and high states, which the computer can "understand".

Phase-shift keying (PSK) is a method of transmitting and receiving digital signals in which the phase of a transmitted signal is varied to convey information. There are several schemes that can be used to accomplish PSK. The simplest method uses only two signal phases: 0 degrees and 180 degrees. The digital signal is broken up timewise into individual bits (binary digits). The state of each bit is determined according to the state of the preceding bit. If the phase of the wave does not change, then the signal state stays the same (low or high). If the phase of the wave changes by 180 degrees, that is, if the phase reverses, then the signal state changes (from low to high, or from high to low). Because there are two possible wave phases, this form of PSK is sometimes called biphase modulation. More complex forms of PSK employ four or eight wave phases. This allows binary data to be transmitted at a faster rate per phase change than is possible with biphase modulation. In four-phase modulation, the possible phase angles are 0, +90, −90, and 180 degrees; each phase shift can represent two signal elements. In eight-phase modulation, the possible phase angles are 0, +45, −45, +90, −90, +135, −135, and 180 degrees; each phase shift can represent four signal elements.

Spread spectrum is a form of communication in which the frequency of the transmitted signal is deliberately varied. This results in a much greater bandwidth than the signal would have if its frequency were not varied. A conventional signal has a frequency, that does not change with time (except for small, rapid fluctuations that occur as a result of modulation). Most spread-spectrum signals use a digital scheme called frequency hopping. The transmitter frequency changes abruptly, many times each second. Between "hops," the transmitter frequency is stable. The length of time that the transmitter remains on a given frequency between "hops" is known as the dwell time. A few spread-spectrum circuits employ continuous frequency variation, which is an analog scheme. The concept as disclosed herein may employ any of these methods of modulation or other methods having desirable properties.

In one embodiment, the sensor will transmit information at frequencies of 600 Hz and 1200 Hz; 1500 Hz and 3000 Hz; 2000 Hz and 2400 Hz; and 2500 Hz and 3000 Hz. By transmitting in a plurality of these frequencies, it is likely that at least one of the transmissions will reach the intended remote location in a sufficient condition to be readable.

It will be understood that while a sensor system is described herein, it is but one example of a device that may employ the concept hereof to communicate within a borehole or into a borehole.

It is also understood that the plurality of transmissions disclosed herein may be over time or simultaneous.

A method of communicating data between a downhole device and a remote location comprises transmitting data a plurality of times over at least one communication line and transmitting at least two different modulation methods over at least two of said plurality of transmissions. Contemplated means include as stated hereinbefore frequency modulation, frequency shift keying, phase shift keying or spread spectrum. It is to be understood however that other means are possible without departing from the scope of the invention.

In other embodiments hereof, the methods of transmission are selectable form a surface location, a downhole location, or by the device itself. Selection of frequency or method ideally takes into account what noise is known to be on the communication line or likely to be on the communication line and thus avoids interference. While the method and apparatus is adaptable and therefore beneficial to the art, two issues of communication need be solved for it to work. The "second" is the transmission of the data for which means of communication must be selected along the lines of the foregoing embodiment. The "first" issue in this selectable embodiment is to get the command signal to the sensor 122 or other tool 120 to select the transmit method for the sensor 122 or tool 120.

In one such selectable embodiment hereof, the method of data transmission (e.g., modulation) and data transmission parameters that the sensor 122 transmits are remotely selected to be at a frequency or at frequencies that are distinct from the noise impressed on the signal.

To send a command signal to the downhole tool 120 or sensor 122, in one embodiment, the voltage amplitude of a signal generated at the remote or at the surface location 110 is modified. The modified signal is sent to a device (120, 122) which receives the signal. A method of variable threshold detection is employed by the downhole tool 120 or sensor 122 to recover the command signal. The variable threshold detection facilitates the determination of the threshold voltage under dynamically varying conditions. The dynamically varying conditions may be induced by the configuration of the whole system at issue and environmental parameters affecting the downhole tool 120 (or sensor 122). The conditions and environmental parameters that can affect terminal voltage at the tool or sensor include, but are not limited to: the number of tools connected, temperature, transmission line construction, transmission line length, voltage produced at the remote location, tool current requirements, transmission line degradation and leakage in the transmission line and/or splices or other interconnects. Combinations of these conditions have a cumulative effect and are likely in many transmission scenarios including those in the downhole environment.

Figure 2:
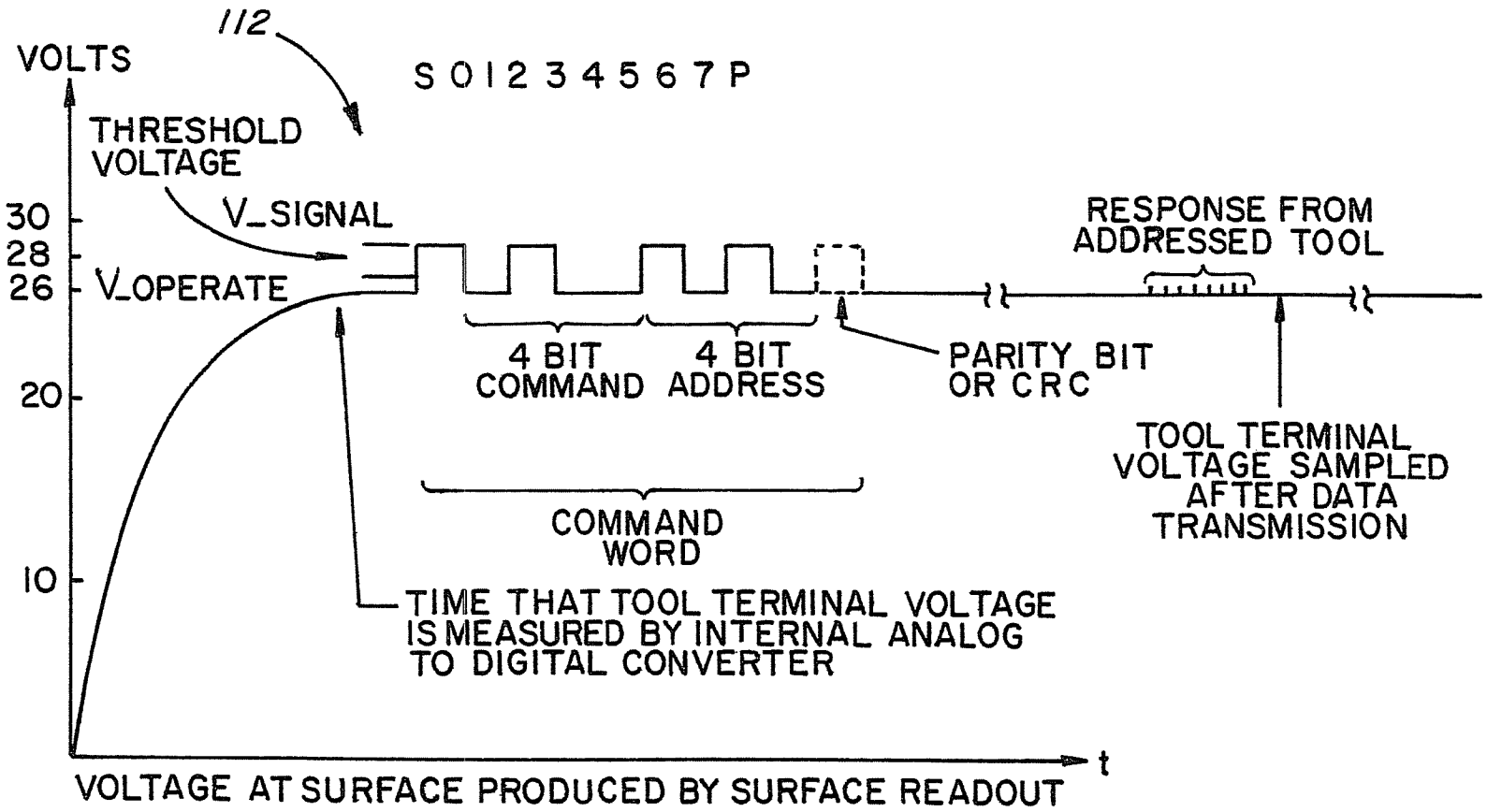
FIG. 2 depicts an exemplary time history indicative of the signals communicated on the transmission media.

Referring now to FIG. 2 as well, in an exemplary embodiment, a pressure/temperature sensor 122, such as a Guardian™ sensor identified above, is modified to include a variable addressing threshold circuit 200 to facilitate receiving a command signal shown generally as 112 from the remote location 110. The command signal 112 with a changing voltage is sent to the addressable downhole tool 120 or sensor 122 by the remote location 110 in a certain sequence. In an exemplary embodiment, the normal operating voltage level that the remote location 110 applies as a command signal 112 to the transmission media 130 connected to the downhole tool(s) 120 or sensor(s) 122 is termed "V_operate". Another voltage level, in this example, a higher voltage, is generated by the surface system 110 as a signal to the downhole tool(s) 120 or sensor(s) 122, and is termed "V_signal". By changing the voltage between two levels "V_operate" and "V_signal", with a particular timing, a digital code is generated. The digital code forms a communication protocol that includes a selected number of bits to represent the address of the tool that is to perform the command and additional bits that represent the command.

FIG. 2 depicts an exemplary time history indicative of the signals communicated on the transmission media. Each downhole tool 120 and/or sensor 122 may be configured with a different address. Methods to implement this addressing include, but are not limited to hard-coding it in the tool 120 or sensor 122 or storing it in a non-volatile memory in the tool 120 or sensor 122. In an exemplary embodiment, the tool 120 or sensor 122 receives the command/address, decodes the address and determines if it matches its own address. If so, then the tool 120 performs the command and transmits the commanded data (if applicable) to the remote location system 110. The command signal 112 sent from the remote location 110 includes but is not limited to: (1) the address of a selected tool 120 and/or sensor 122; (2) the method of signal modulation for transmission; and (3) the parameters of data transmission that the downhole tool 120 or sensor 122 is to utilize to transmit information to the remote location 110. For modulation information, in the case of a frequency shift keying (FSK) modulation scheme, the command signal 112 includes the transmit frequencies or in the case of spread spectrum transmission the code hopping interval and frequency range.

Advantageously, in an exemplary embodiment, the addressing method also ensures that each downhole tool 120 or sensor 122 transmits to the surface system 110 as data, the terminal voltage as received at the particular downhole tool 120 or sensor 122. In the instance when there is a sufficiently large voltage drop that the downhole tool 120 or sensor 122 does not receive enough voltage to discriminate the command signal 112, then the controller of the remote location 110 increases its output voltage, (V_operate). Once the downhole tool 120 or sensor 122 can discriminate the command signal 112 sent by the remote location 110, a determination may be made as to the voltage drop resultant from transmission attributable to the transmission media 130. By determining the "resistance" in the transmission media 130 from tables or using Ohms law, the temperature and the current utilized by the tools, it can be determined if the command signal voltages (V_operate and V_signal) should be increased to provide sufficient voltage to facilitate communication and operation of the tools 120 and/or sensor(s) 122.

Referring now to FIG. 3, a simplified block diagram of an exemplary embodiment including a variable addressing threshold circuit 200 is depicted. In an implementation of an exemplary embodiment, when each downhole tool 120 or sensor 122 is first powered, and at selected instances thereafter, an analog to digital converter 202 is employed to measure the applied tool terminal voltage (or a voltage corresponding thereto) denoted $V_{TERM}$. A value corresponding to the terminal voltage is stored in memory 204. A value corresponding to a selected reference threshold is computed either by a formula or by table lookup. In an exemplary embodiment, the reference threshold is selected to a small increment above measured tool terminal voltage 210. A voltage denoted $V_{THRESH}$ is generated corresponding to the reference threshold by a digital to analog converter 206 and thereafter applied to one input of a comparator 208 for comparison with the measured tool terminal voltage, $V_{TERM}$. Note that this value is variable and may change as a function of the above mentioned variables including: number of tools installed, current drain of each tool, position of the tool in the tool string, temperature and type of transmission line, degradation of transmission line, interconnects, and the like, as well as combinations including at least one of the foregoing.

The other input to the comparator 208 is the tool terminal voltage $V_{TERM}$. The comparator 208 is employed to decode the change of terminal voltage that the surface system 110 provides. In an exemplary embodiment, the actual tool terminal voltage is scaled to avoid exceeding the allowable input range of the comparator 208. When the measured input terminal voltage, $V_{TERM}$, for the tool 120 exceeds the selected reference threshold voltage, $V_{THRESH}$, the output of the comparator 208 changes state. This signifies that a larger voltage has been received at the downhole tool 120 and/or sensor 122 indicating that the command signal 112 includes command information to be decoded. Thereafter, individual command and address bits are decoded at 210 and if the tool 120 was addressed, the command performed. It should be noted that FIG. 3 illustrates decoder 210 within a dashed line connected to controller 212 indicating that the functionality of decoder 210 may be incorporated into controller 212 if desired.

Continuing with FIG. 3, in an exemplary embodiment, at block 212 if the decoding at 210 indicates that the downhole tool 120 and/or sensor 122 was addressed, a controller performs the commands requested and transmits the data back to the remote location 110. In an exemplary embodiment, the transmission is accomplished by switching a voltage signal to once again modulate a voltage signal on the transmission media 130. In an exemplary embodiment, a switching device 214 responsive to a control signal from the controller 212 switches a current across a resistive element 216 to affect the modulation for transmission. In yet another embodiment, an optional digital to analog converter 220 is employed on an output from controller 212 to drive a power driver 222 and enable other forms of modulation such as continuous sinusoidal frequency modulation (FM) Moreover, this modulation could be employed simultaneously with the modulation provided by switching device 214. It will be appreciated that the configuration of the variable addressing threshold circuit 200 need not be limited to that described herein. One skilled in the art will now recognize numerous equivalents and variations that may be employed without deviating from the scope and breadth of the claims. It will further be appreciated that the transmission of information to the remote location 110 results in a reduction of the voltage along the entire transmission line of the transmission media 130 because it is switching current to ground. Therefore, when a particular downhole tool 120 and/or sensor 122 is transmitting, the effect on the voltage impressed on the transmission media 130 by other sources is reduced and therefore will not result in another downhole tool incorrectly recognizing the voltage change as a command signal.

Referring once again to FIG. 2, a standardized asynchronous character stream composed of one start bit, eight data bits, one stop bit and one parity bit is depicted. It will be appreciated that a wide variety of communication protocols or standards may be employed including standard and non-standard or proprietary protocols. Alternatively, well-known error correction code methodologies could be used, for example, using an $x^8+x^2+x+1$ polynomial. Similarly, utilizing a parity bit provides a small amount of error detection for the command and address transmitted while a CRC bit facilitates correction of one-bit errors. In an exemplary embodiment, additional discrimination is provided between the signal transmitted by the downhole tool 120 or sensor 122 and the signal to the downhole tool 120 and/or sensor 122 by the remote location 110 because the frequencies employed for each are widely separated. For example, the downhole tool 120 and/or sensor 122 transmit at frequencies in excess of about 1000 Hz and the remote location at about 10 Hz. It will be appreciated that other frequencies may be employed. Similarly, in an exemplary embodiment, a baud rate for the command signal 112 with the command and address bits is selected to be 10 Hz. However, other data rates are conceivable.

Figure 4:
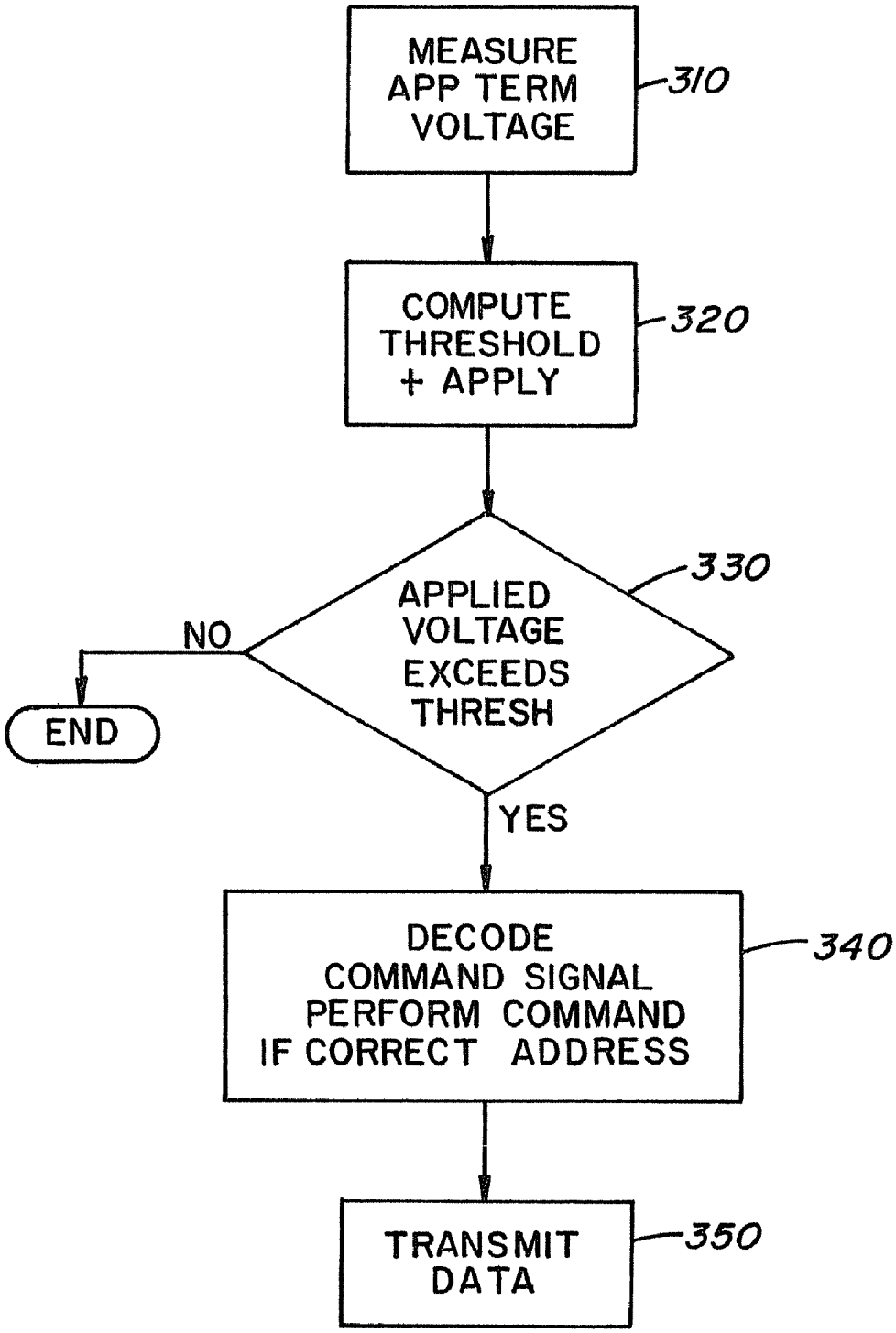
FIG. 4 depicts a simplified flow chart of an exemplary methodology.

Turning now to FIG. 4, a simplified flow chart of an exemplary methodology 300 is depicted. At process block 310, the downhole terminal voltage $V_{TERM}$ is measured. The reference threshold $V_{THRESH}$ is determined and generated at process block 320. Thereafter, at decision block 330, the terminal voltage $V_{TERM}$ and the reference threshold voltage $V_{THRESH}$ are compared to ascertain if the reference threshold voltage has been exceeded, indicating a command has been transmitted by the remote location 110. Turning to process block 340, if a command is detected and decoded by the addressed downhole tool 120 or sensor 122, the command is performed. Finally, at process block 350 the requested information is transmitted to the surface system 110.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A method of communicating data between a downhole device and a remote location comprising:

generating a communication signal at the remote location by modifying a voltage amplitude of said signal;

receiving said communication signal employing a variable addressing threshold circuit in the downhole device, wherein said variable addressing threshold circuit is configured to facilitate dynamic determination of a threshold voltage under varying conditions;

measuring voltage of said communication signal at said variable addressing threshold circuit; and determining the threshold voltage based upon said measured voltage.

2. A method of communicating data between a downhole device and a remote location as claimed in claim 1 wherein said method further includes decoding said signal to recover said communication signal.

3. A method of communicating data between a downhole device and a remote location as claimed in claim 1 wherein said varying conditions include effects impressed on the communication signal by at least one of a configuration and an environmental parameter.

4. A method of communicating data between a downhole device and a remote location as claimed in claim 3 wherein said configuration and said environmental parameter include at least one of: number of downhole devices connected, temperature, voltage amplitude produced, voltage frequency generated, downhole device current requirements, transmission medium characteristics, transmission medium construction, transmission medium length, transmission medium degradation and leakage in said transmission medium, leakage in transmission medium interconnects.

5. A method of communicating data between a downhole device and a remote location as claimed in claim 1 further including at least one of:

selecting a method of data transmission; and selecting data transmission parameters.

6. A method of communicating data between a downhole device and a remote location as claimed in claim 5 wherein at least one of said selecting a method of data transmission and said selecting data transmission parameters is calculated to ensure that a transmitted communication signal is outside a noise impressed on said signal.

7. A method of communicating data between a downhole device and a remote location as claimed in claim 1 wherein said communication signal includes at least one of: an address of a selected downhole device, a method of signal modulation for transmission, and a parameter that said device is to transmit to the remote location.

8. A method of communicating data between a downhole device and a remote location as claimed in claim 7 wherein said method of signal modulation includes at least one of frequency modulation, frequency shift keying, phase shift keying and spread spectrum.

9. A method of communicating data between a downhole device and a remote location as claimed in claim 1 wherein said method further includes transmitting data from said downhole device via a method dictated by said communication signal.

10. A method of communicating data between a downhole device and a remote location as claimed in claim 9 wherein said method of transmitting is by repeating the transmission a plurality of times at different frequencies.

11. A method of communicating data between a downhole device and a remote location as claimed in claim 10 wherein said method of transmitting is by repeating the transmission a plurality of times at different phases.

12. A method of communicating data between a downhole device and a remote location as claimed in claim 10 wherein said method of transmitting is by repeating the transmission a plurality of times by spread spectrum means.

13. A system for communicating data between a downhole device and a remote location comprising:

a remote device for generating a communication signal, said remote device configured to modify a voltage amplitude of said communication signal;

a transmission medium in operable communication with said remote device;

a downhole device in operable communication with said transmission medium, said downhole device configured to receive said communication signal; and wherein said downhole device includes a variable addressing threshold circuit to recover said communication signal, wherein said variable addressing threshold circuit is configured to facilitate dynamic determination of a threshold voltage under varying conditions, wherein said variable addressing threshold circuit is further configured to measure voltage of said communication signal at said variable addressing threshold circuit and to determine the voltage threshold based upon said measured voltage.

14. A system for communicating data between a downhole device and a remote location as claimed in claim 13 wherein said remote device is configured to facilitate at least one of:

selection of a method of data transmission; and selection of data transmission parameters.

15. A system for communicating data between a downhole device and a remote location as claimed in claim 13 wherein at least one of said selection of a method of data transmission and said selection of data transmission parameters ensures that a transmitted communication signal is outside of a noise impressed on said signal.

16. A method of communicating data between a downhole device and a remote location as claimed in claim 1 wherein said communication signal includes at least one of: an address of a selected downhole device, a method of signal modulation for transmission, and a parameter that said downhole device is to transmit to the remote device.

17. A method of communicating data between a downhole device and a remote location as claimed in claim 16 wherein said method of signal modulation includes at least one of frequency modulation, frequency shift keying, phase shift keying and spread spectrum.

18. A system for communicating data between a downhole device and a remote location as claimed in claim 13 wherein said downhole device is configured to transmit data to said remote location on said transmission medium in accordance with instructions.

19. A method of communicating data between a downhole device and a remote location as claimed in claim 1, further comprising transmitting said measured voltage from the downhole device to the remote location, wherein said remote location is configured to adjust an output voltage of said communication signal using said measured voltage so that said downhole device can discriminate said communication signal.

20. A system for communicating data between a downhole device and a remote location as claimed in claim 13 wherein said variable addressing threshold circuit is further configured to transmit said measured voltage from the downhole device to the remote location, wherein said remote location is configured to adjust an output voltage of said communication signal using said measured voltage so that said downhole device can discriminate said communication signal.

* * * * *